US005122260A

United States Patent [19]

Gupta et al.

[11] Patent Number: 5,122,260

[45] Date of Patent: Jun. 16, 1992

[54] LIQUEFACTION OF SOLID CARBONACEOUS MATERIAL WITH CATALYST RECYCLE

[75] Inventors: Avinash Gupta, Bloomfield; Marvin I. Greene, Oradell, both of N.J.

[73] Assignee: ABB Lummus Crest Inc., Bloomfield, N.J.

[21] Appl. No.: 295,006

[22] Filed: Jan. 9, 1989

Related U.S. Application Data

[63] Continuation of Ser. No. 98,039, Sep. 17, 1987, abandoned.

[51] Int. Cl.[5] ..... C10G 1/08

[52] U.S. Cl. ..... 208/412; 208/413; 208/416; 208/417; 208/420

[58] Field of Search ..... 208/412, 413, 416, 417, 208/420

[56] References Cited

U.S. PATENT DOCUMENTS

| | | | |
|---|---|---|---|
| 3,679,573 | 7/1972 | Johnson | 208/419 X |
| 3,932,266 | 1/1976 | Sze et al. | 208/413 |
| 4,157,291 | 6/1979 | Paraskos et al. | 208/413 |
| 4,411,767 | 10/1983 | Garg | 208/413 |
| 4,473,460 | 9/1984 | Kuerten et al. | 208/413 |

*Primary Examiner*—Asok Pal

*Attorney, Agent, or Firm*—Elliot M. Olstein; Raymond J. Lillie

[57] ABSTRACT

In the two stage liquefaction of a carbonaceous solid such as coal wherein coal is liquefied in a first stage in the presence of a liquefaction solvent and the first stage effluent is hydrogenated in the presence of a supported hydrogenation catalyst in a second stage, catalyst which has been previously employed in the second stage and comminuted to a particle size distribution equivalent to 100% passing through U.S. 100 Mesh, is passed to the first stage to improve the overall operation.

5 Claims, 1 Drawing Sheet

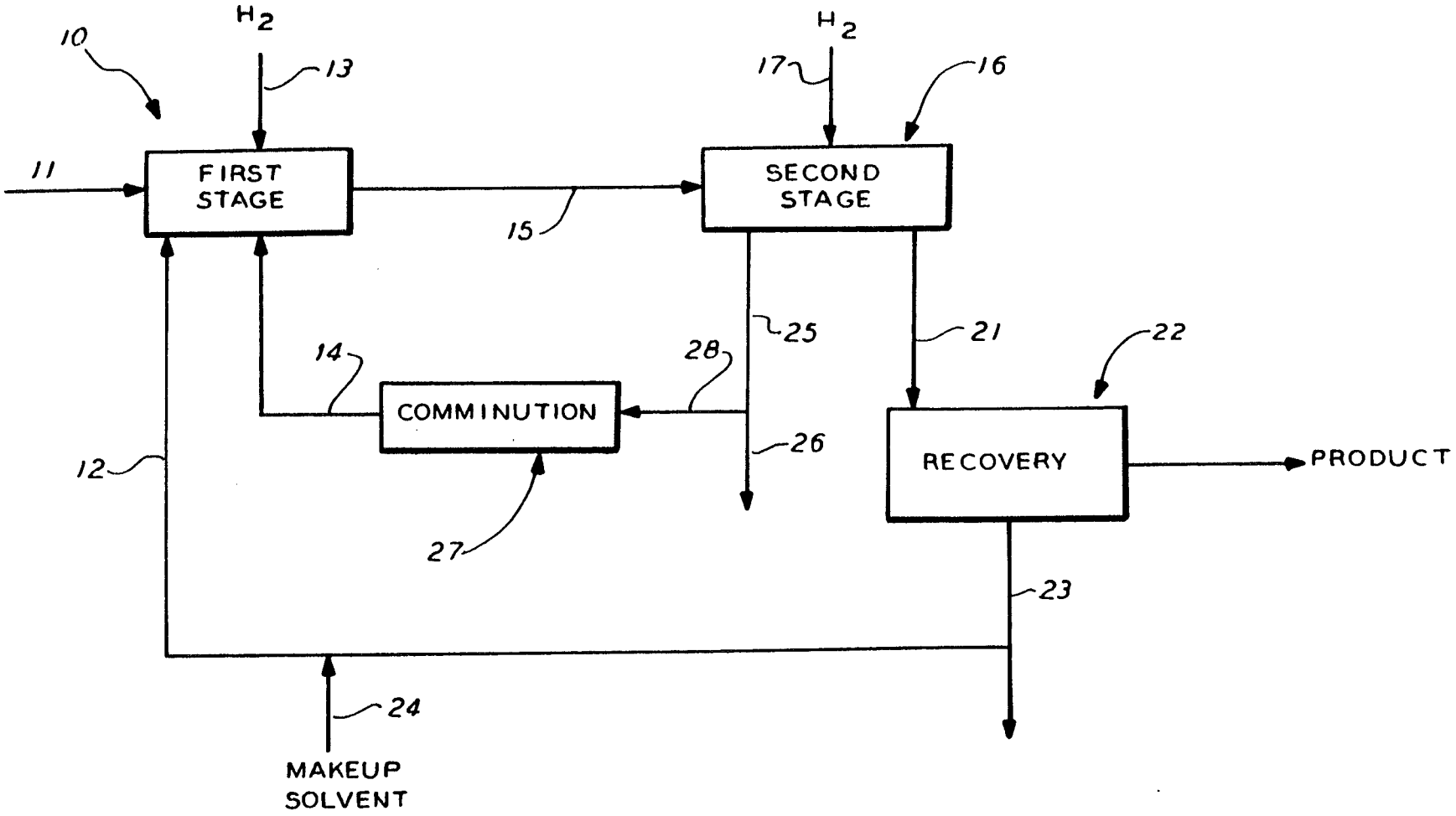
PRODUCT
22
RECOVERY
23
16
21
SECOND STAGE
H2
17
25
26
28
COMMINUTION
27
15
24
MAKEUP SOLVENT
13
14
H2
FIRST STAGE
10
11
12

LIQUEFACTION OF SOLID CARBONACEOUS MATERIAL WITH CATALYST RECYCLE

The Government of the United States of America has rights in this invention pursuant to Contract No. DE-AC22-84PC70042 awarded by the U.S. Department of Energy.

This application is a continuation of application Ser. No. 07/098,039 filed Sep. 17, 1987, now abandoned.

This invention relates to the processing of carbonaceous solids, and more particularly to the liquefaction of carbonaceous solids.

Carbonaceous solids, and in particular coal, have been liquefied in order to produce refinery like hydrocarbon liquids, and in particular distillates. In generally, the liquefaction of carbonaceous solids, and in particular coal, involves a two-step procedure, with the first step providing for liquefaction of the coal in the presence of a liquefaction solvent, and the second step providing for upgrading of first stage liquefaction effluent to distillates by catalytic hydrogenation.

The present invention is directed to an improvement in a two stage liquefaction process.

In accordance with an aspect of the present invention, there is provided a two-stage liquefaction process for the upgrading of carbonaceous solids wherein the carbonaceous solid is liquefied in the presence of a liquefaction solvent in a first stage, and effluent from the first stage is upgraded in a second stage by hydrogenation in the presence of a hydrogenation catalyst, with catalyst which has been used in the second stage being passed to the first stage to accelerate the dissolution and cracking reactions which occur in the first stage.

More particularly, in accordance with the present invention, a two-stage process for the liquefaction of carbonaceous solids, and in particular coal, is improved by employing catalyst which has been previously used in the second catalytic hydrogenation stage in the first thermal liquefaction stage. Applicants have found that the catalyst employed in the second stage, which undergoes a degree of deactivation in such second stage, and which has a somewhat lower activity, may be employed in the first stage of the process in which the available active catalyst sites can be used to catalyze dissolution of carbonaceous solids, hydrogenation of donor solvent and preasphaltenes and hydro-cracking of heavy (850° F.+) extract materials.

In this manner, the second stage reactor is periodically purged of catalyst, with the second stage being replenished with fresh catalyst, with all or a portion of the purged catalyst from the second stage being employed in the first stage thermal liquefaction.

The catalyst recovered from the second stage is preferably comminuted to a size which is suitable for slurrying with the feed to the first stage. In general, the particle size of such catalyst should be less than U.S. 100 mesh; i.e., the catalyst prior to slurrying in the feed to the second stage is such that essentially 100% passes through U.S. 100 mesh. In most cases, the catalyst has a particle size that 100% passes through U.S. 100 mesh and at least 70% passes through U.S. 325 mesh.

The partially used second stage catalyst is preferably added to the first stage feed in an amount effective to catalyze dissolution of the carbonaceous solid. In general, the catalyst is added in an amount to provide a steady state catalyst concentration in the first stage of at least 0.2%, and preferably at least 2.0%, all by weight.

The amount of catalyst added should not exceed the amount at which the feed to the first stage is a pumpable slurry for the first stage.

The first stage is a thermal liquefaction stage, and the carbonaceous solid is liquefied in the presence of a suitable liquefaction solvent. Such liquefaction solvents are well known in the art, and no details in this respect are needed for a complete understanding of the present invention.

In accordance with a preferred embodiment of the invention, all or a portion of the liquefaction solvent requirements for the first stage may be provided by recovery of material from the second stage effluent which is comprised of 850° F.−liquid, as well as 850° F.+ liquid. Thus, the material recovered from the second stage, which is generally employed in formulating liquefaction solvent is comprised of 500° F.+ material which includes materials which boil within the range from 500° F. to 850° F. (850° F.− material) as well as the materials which boil above 850° F. (850° F.+ materials). The relative portions of 850° F.− material and 850° F.+ material present in the recycle solvent may be as disclosed, for example, in U.S. Pat. Nos. 4,547,282; or 4,545,890; or 4,444,476.

In general, the first stage is operated at a temperature from about 700° F. to about 900° F., and most generally in the order of from about 800° F. to 875° F. Contact times at such temperatures are generally in the order of from 0.5 minute to 40 minutes. In the first stage, the carbonaceous solid is liquefied in the presence of a liquefaction solvent and further in the presence of catalyst derived from the second stage at elevated pressures. In most cases, gaseous hydrogen is also introduced into the first stage. The liquefaction pressure is generally from 500 to 3,500 psig, and hydrogen when used is generally added to the first stage in amounts of from 4,000 to 18,000 SCF per ton of carbonaceous solids. It is to be understood, however, that the conditions described are illustrative of those generally employed in the first stage. The first stage liquefaction may be accomplished in a fired tube heater.

The reaction contact time in the first stage is sufficient to effect liquefaction of the carbonaceous solid. The first stage liquefaction may be accomplished in a tubular heater, and if additional time is needed for effecting the liquefaction, a soaker may be used in conjunction with the heater to increase contact time.

The liquefaction solvent which is employed in the first stage is employed in an amount sufficient to effect liquefaction of the carbonaceous solid. In general, the amount of liquefaction solid does not exceed three parts of solvent per one part of carbonaceous solid on a weight basis.

The feed to the second stage generally includes essentially all of the effluent from the first stage including the comminuted slurried catalyst.

It is also possible to separate some 850° F− material prior to introduction of the first stage effluent into the second stage.

In the second stage, effluent from the first stage is catalytically hydrogenated to produce distillates. In general, the second stage is operated at a temperature from 650° F. to 890° F., and at a pressure in the order of from 1,000 to 4,000 psig. The second stage includes a hydrogenation catalyst of a type known in the art; for example, an oxide or sulfide of a Group VI and/or a Group VIII metal. In most cases, such metal oxide or sulfide is supported on a suitable support, such as alumina or silica-alumina. As representative examples of catalyst, there may be mentioned cobalt-molybdenum or nickel-molybdenum supported on alumina or silica-alumina.

In accordance with a preferred embodiment, the second stage hydrogenation is accomplished in an upflow expanded-bed, with such expanded bed being of a type known in the art.

In accordance with the present invention, periodically, a portion of the second stage catalyst is purged, with at least a portion of such purged portion being employed in the first stage of the process. The thus purged catalyst is first subjected to comminution typically by wet ball milling or other state-of-the-art crushing methods, prior to recycle to the first-stage.

The carbonaceous solid which may be treated in accordance with the various aspects of the present invention may be any one of a wide variety of such solids including but not limited to various types of coal, lignite, peat, oil shale, tar, sands, biomass and the like, with the preferred carbonaceous solid feed being coal.

In accordance with an aspect of the present invention, it is possible to add a heavy petroleum oil to the first stage or the second stage in order to accomplish co-processing of the heavy petroleum oil along with liquefaction of the carbonaceous solid. In most cases, the heavy petroleum oil is added to the second stage. It is also possible to add the heavy petroleum oil to the first stage, provided that the heavy petroleum oil is hydrogenated prior to such addition. In general, such heavy petroleum oil has an initial boiling point in excess of about 600° F. As representative, examples of such petroleum oils, there may be mentioned virgin vacuum residuum; unconverted residue from the hydro-treatment of virgin vacuum residuum; unconverted residue from the fluid catalytic cracking of virgin residuum; unconverted residue from the heavy cycle oil from a fluid catcracker; unconverted residue from the visbreaking of virgin residuum; asphalt fractions from a virgin residuum deasphalter; etc.

Further details with respect to preferred aspects of coprocessing a heavy petroleum oil with the liquefaction of a solid carbonaceous feed are disclosed in copending U.S. patent application Ser. No. 07/071,812, filed on Jul. 10, 1987.

The present invention will be further described with respect to an embodiment thereof illustrated in the accompanying drawing, wherein:

BRIEF DESCRIPTION OF DRAWING

The drawing is a simplified schematic representation of an embodiment of the present invention.

It is to be understood, however, that the scope of the present invention is not limited to the embodiment described with reference to the drawing.

Referring now to the drawing, there is shown a first liquefaction stage schematically generally indicated as 10, which is provided with a carbonaceous solid, in particular coal, through line 11; liquefaction solvent through line 12; hydrogen through line 13, and second stage catalyst through line 14.

In the first stage 10, the coal and partially used catalyst from the second stage are slurried in the liquefaction solvent, and such slurry and gaseous hydrogen are introduced into a thermal liquefaction heater, which is operated at temperatures and pressures as hereinabove described to effect liquefaction of the coal. The first stage 10 may also include a soaker, in addition to the tubular heater in order to increase the residence time.

A first stage effluent is withdrawn from the stage 10 through line 15 and introduced into a second stage, schematically indicated as 16, along with gaseous hydrogen, provided through line 17. The second stage includes a hydrogenation catalyst, of the type hereinabove described, and is operated at the conditions hereinabove described in order to upgrade the first stage effluent and produce distillates.

A second stage effluent is withdrawn from second stage 16 through line 21 for introduction into a separation and recovery zone schematically generally indicated as 22.

In separation and recovery zone 22, there is recovered a fraction which is comprised of materials which boil up to about 500° to 650° F., as a lighter product, and a distillate product, which is comprised of material which boils in the order of from 500° to 850° F. Such materials are collectively designated as product in the drawing. In addition, there is recovered through line 23 a recycle liquefaction solvent which liquefaction solvent is comprised of both 850° F.− and 850° F.+ material. Additional makeup solvent may be provided through line 24, and the combined stream introduced into the first stage through line 12.

In accordance with the present invention, periodically used catalyst is purged from the second stage 16 through line 25, and all or a portion of such catalyst is provided to the comminution zone 27 through line 28. The thus comminuted purged catalyst is then provided to the first stage through line 14. Any portion of the catalyst which is not recycled to the first stage through line 14 may be purged from the system through line 26.

A portion of the stream withdrawn through line 23 may be purged from te system to thereby remove insoluble material; particularly that derived from the carbonaceous material from the system.

Thus, the comminuted catalyst derived from the second stage is circulated through both the first and second stage to provide steady state levels for the first stage, as hereinabove described. A portion of the comminuted catalyst is purged from the system along with insolubles derived from the carbonaceous material. The material provided through line 28 maintains the finely divided catalyst in the feed to the first stage in an amount of at least 0.2%, by weight.

Although an embodiment of the invention has been described with reference to the accompanying drawing, it is to be understood that modifications may be effected within the spirit and scope of the present invention.

Thus, for example, insoluble material may be separated from the first stage effluent, prior to introduction thereof into the second stage.

As a further alternative, a heavy petroleum feed may also be introduced into the second stage or as another alternative, a hydrogenated heavy petroleum feed may be introduced into the first stage.

These and other modifications should be apparent to those skilled in the art from the teachings herein.

The invention will be further described with respect to the following examples; however, the scope of the invention is not to be limited thereby.

EXAMPLE 1

In the first stage 10, coal slurry consisting of 36 wt. % coal and 64 wt. % process solvent is passed through a short contact time, plug flow heater. The coil outlet temperature is maintained at 437° C. and 2000 psig. The slurry then passes to a soaker zone where the slurry residence time (above 315° C.) is held at approximately 20 minutes. 92% of the organic matter in coal is dissolved under these conditions and the coal extract consisting of oils, Asphaltenes, Preasphaltenes, Insoluble organic matter and ash is subsequently sent to an expanded-bed hydrocracking reactor (Second Stage 16). The reactor is isothermally maintained at 427° C., 2000 psig pressure and operated at a liquid hourly space velocity (LHSV) of 0.21 $hr^{-}$.

The overall product yields and distillate properties are listed in Tables 1 and 2.

EXAMPLE 2

This example illustrates the disclosed invention in which the spent catalyst from the second-stage of a two-stage operation is reutilized in the first-stage. Coal slurry prepared from Illinois No. 6 Bituminous coal and coal-derived donor solvent (343°–537° C. boiling range) containing 40 wt. % coal, 60 wt. % process solvent and 0.5 lbs/barrel of second stage comminuted purged $NiMo/Al_2O_3$ catalyst is liquefied in a reactor at 425° C./17 min./1000 psig $H_2$ reaction severity (First Stage 10). The comminuted catalyst is recycled until it reaches a steady-state concentration in the slurry paste to the first-stage of 0.5%. Coal conversion of 94.0 wt. % (MAF coal) is obtained during this first stage operation. Further, the preasphaltene content of the coal extract from this operation is about 70 wt. % of that which was obtained in Example 1.

The first stage extract is then mixed with 0.5 lbs. of fresh catalyst/barrel and is subsequently hydrocracked at reaction severity of 415° C./0.5 LHSV/2000 psig in an expanded-bed hydrotreater (Second Stage 16).

The overall product yields and distillate properties are shown in Tables 3 and 4. As compared to Example 1, there is an improvement in coal conversion, 850° F.+ conversion and distillate yield.

EXAMPLE 3

This example is similar to Example 2 except that the first reactor is operated at 429° C./3 min./750 psig reaction severity (First Stage 10). The coal paste slurry rates are essentially the same as shown in Example 2 and the comminuted catalyst recycle rate is 2.0 lbs/barrel to maintain a steady-state concentration in the slurry paste to the first-stage of 3.0%. Coal conversion of 94.5% (MAF basis) is obtained in the first hydroliquefaction stage. The preasphaltene content of the coal extract is reduced to about 60 wt. % of that which was obtained in Example 1 operation.

The first stage extract when hydrocracked at a second stage severity of 420° C./1 LHSV/750 psig and fresh catalyst rate of 0.5 lbs./barrel (Second Stage 16) produced a distillate product even superior to that of Examples 1 and 2. The results are reported in Tables 5 and 6.

TABLE 1

OVERALL PRODUCT YIELDS FOR EXAMPLE 1

| Yields | Wt. % Moisture Free |
|---|---|
| Heteroatoms ($H_2S$, $NH_3$, $H_2O$) | 13.6 |
| $C_1$-$C_4$ | 6.6 |
| $C_5$-400° F. | 10.4 |
| 400–650° F. | 28.6 |
| 650–850° F. | 6.4 |
| 850° F.+ (Solids Free) | 22.0 |
| IOM | 7.3 |

TABLE 1-continued

OVERALL PRODUCT YIELDS FOR EXAMPLE 1

| Yields | Wt. % Moisture Free |
|---|---|
| Ash | 10.2 |
| Total | 104.8 |

TABLE 2

PROPERTIES OF DISTILLATE FRACTIONS FOR EXAMPLE 1

| | | WT. % | | | | |
|---|---|---|---|---|---|---|
| Product | °API | Carbon | Hydrogen | Oxygen | Nitrogen | Sulfur |
| $C_5$-390° F. Naphtha | 41.1 | 85.67 | 13.78 | 0.41 | 0.14 | 0.10 |
| Light Distillate | 21.4 | 86.87 | 10.97 | 1.64 | 0.21 | 0.31 |
| Medium Distillate | 12.3 | 88.84 | 10.29 | 0.26 | 0.21 | 0.40 |
| Heavy Distillate | 3.6 | 89.43 | 9.06 | 0.32 | 0.19 | 0.60 |
| Total Distillate | 15.5 | 88.00 | 10.55 | 0.56 | 0.19 | 0.30 |

TABLE 3

OVERALL PRODUCT YIELDS FOR EXAMPLE 2

| Yields | Wt. % (Moisture Free Coal Basis) |
|---|---|
| Heteroatoms | 15.0 |
| $C_1$-$C_4$ | 6.5 |
| $C_5$-400° F. | 11.5 |
| 400–650° F. | 36.0 |
| 650–850° F. | 7.0 |
| 850° F.+ (Solids Free) | 13.9 |
| IOM | 5.4 |
| Ash | 10.2 |
| Total | 105.5 |

TABLE 4

PROPERTIES OF DISTILLATE FRACTIONS FOR EXAMPLE 2

| | | WT. % | | | | |
|---|---|---|---|---|---|---|
| Product | °API | Carbon | Hydrogen | Oxygen | Nitrogen | Sulfur |
| $C_5$-390° F. Naphtha | 42.5 | 85.73 | 13.79 | 0.37 | 0.13 | 0.10 |
| Light Distillate | 23.0 | 87.04 | 11.00 | 1.48 | 0.19 | 0.29 |
| Medium Distillate | 13.0 | 88.90 | 10.30 | 0.23 | 10.9 | 0.38 |
| Heavy Distillate | 3.8 | 89.92 | 9.06 | 0.29 | 0.17 | 0.56 |

TABLE 5

OVERALL PRODUCT YIELDS FOR EXAMPLE 3

| Yields | Wt. % (Moisture Free Coal Basis) |
|---|---|
| Heteroatoms | 14.5 |
| $C_1$-$C_4$ | 4.8 |
| $C_5$-400° F. | 12.0 |
| 400–650° F. | 40.0 |
| 650–850° F. | 7.2 |
| 850° F.+ (Solids Free) | 12.2 |
| IOM | 4.9 |
| Ash | 10.2 |
| Total | 105.8 |

TABLE 6

PROPERTIES OF DISTILLATE FRACTIONS FOR EXAMPLE 3

| | | WT. % | | | | |
|---|---|---|---|---|---|---|
| Product | °API | Carbon | Hydrogen | Oxygen | Nitrogen | Sulfur |
| $C_5$-390° F. Naphtha | 43.0 | 85.71 | 13.81 | 0.36 | 0.12 | 0.1 |
| Light Distillate | 23.5 | 86.94 | 11.15 | 1.45 | 0.18 | 0.28 |
| Medium Distillate | 13.0 | 88.88 | 10.38 | 0.21 | 0.18 | 0.35 |

TABLE 6-continued

PROPERTIES OF DISTILLATE FRACTIONS FOR EXAMPLE 3

| Product | °API | WT. % Carbon | Hydrogen | Oxygen | Nitrogen | Sulfur |
|---|---|---|---|---|---|---|
| Heavy Distillate | 3.8 | 89.90 | 9.15 | 0.27 | 0.15 | 0.53 |

The present invention is particularly advantageous in that there is provided an improvement in a two stage liquefaction process. By employing partially used catalyst in its comminuted form from the second stage in the first stage, whereby, in effect, there is a countercurrent catalyst cascading operation, there is obtained an improvement in conversion, heteroatom removal and reaction severity. In addition, the product yields and distillate oil properties are improved.

These and other advantages should be apparent to those skilled in the art.

Numerous modifications and variations of the present invention are possible in light of the above teachings and, therefore, within the scope of the appended claims, the invention may be practiced otherwise than as particularly described.

What is claimed is:

1. A process for liquefying a carbonaceous solid in two stages, comprising:

slurrying a carbonaceous solid and hydrogentation catalyst containing a compound of at least one metal from Group VI or Group VIII supported on a solid support, said hydrogenation catalyst being derived from a second stage in a liquefaction solvent to form a pumpable slurry;

passing said slurry through a tubular heater in a first stage to heat the pumpable slurry and liquefying the carbonaceous solid at a temperature of from about 700° F. to 900° F. and to produce liquefied product;

contacting liquefied product with hydrogen in the presence of an expanded bed of said hydrogenation catalyst in a second stage to produce distillates;

recovering and comminuting a portion of the hydrogenation catalyst from the second stage to produce a hydrogenation catalyst of less than U.S. 100 mesh; and employing comminuted second stage hydrogenation catalyst for producing the pumpable slurry.

2. The process of claim 1 wherein the concentration of catalyst slurried in the liquefaction solvent is maintained at at least 0.2% by weight.

3. The process of claim 2 wherein said concentration is at least 2%, by weight.

4. The process of claim 1 wherein the carbonaceous solid is coal.

5. The process of claim 1 wherein said liquefied product is contacted with hydrogen in the presence of a hydrogenation catalyst in said second stage at a temperature of from 650° F. to 890° F.

* * * * *